United States Patent [19]

Frazita

[11] Patent Number: 4,536,766

[45] Date of Patent: Aug. 20, 1985

[54] SCANNING ANTENNA WITH AUTOMATIC BEAM STABILIZATION

[75] Inventor: Richard F. Frazita, St. James, N.Y.

[73] Assignee: Hazeltine Corporation, Commack, N.Y.

[21] Appl. No.: 415,057

[22] Filed: Sep. 7, 1982

[51] Int. Cl.[3] ..... H01Q 3/22; H01Q 3/24; H01Q 3/26

[52] U.S. Cl. ..... 343/372; 343/351

[58] Field of Search ..... 343/372, 351, 844, 854, 343/893, 894, 17.7, 7 A

[56] References Cited

U.S. PATENT DOCUMENTS

| | | | |
|---|---|---|---|
| 3,158,861 | 11/1964 | Iribe | 343/17.7 |
| 3,345,631 | 10/1967 | Chamberlin, Jr. | 343/372 |
| 3,355,735 | 11/1967 | Chait | 343/372 X |
| 3,434,142 | 3/1969 | Andre et al. | 343/372 X |
| 3,435,453 | 3/1969 | Howard | 343/372 X |
| 3,438,044 | 3/1969 | Elia et al. | 343/777 X |
| 3,510,581 | 5/1970 | Craiglow | 343/351 X |
| 3,683,374 | 8/1972 | Honold | 343/372 X |
| 3,745,574 | 7/1973 | Daugny et al. | 343/7 A |
| 3,978,482 | 8/1976 | Williams et al. | 343/372 X |
| 4,034,374 | 7/1977 | Kruger | 343/372 X |
| 4,041,501 | 8/1977 | Frazital et al. | 343/373 X |
| 4,195,289 | 3/1980 | Cole | 343/778 X |
| 4,315,250 | 2/1982 | Hanell et al. | 343/372 |

*Primary Examiner*—Theodore M. Blum
*Assistant Examiner*—Brian Scott Steinberger
*Attorney, Agent, or Firm*—E. A. Onders; F. R. Agovino

[57] ABSTRACT

A external feedback network for decreasing variations in a beam pointing angle of a scanning antenna array. A dedicated aperture manifold is intergral with the aperture of the scanning antenna and provides a signal which represents the beam pointing angle. The signal is detected, decoded, and converted into digital data for averaging and processing by a CPU. The processed data is then compared with a value stored in memory and any difference forms the basis of a correction signal. For application to a microwave landing system, the correction signal is used to adjust the start/stop time of the scanning commands of the antenna to remove the error without modifying the beam steering algorithm. A space-coupled monitor may also be used independent of the feedback network to provide an alarm in response to any failure of the dedicated aperture manifold, the automatic stabilization circuitry or the array system.

2 Claims, 1 Drawing Figure

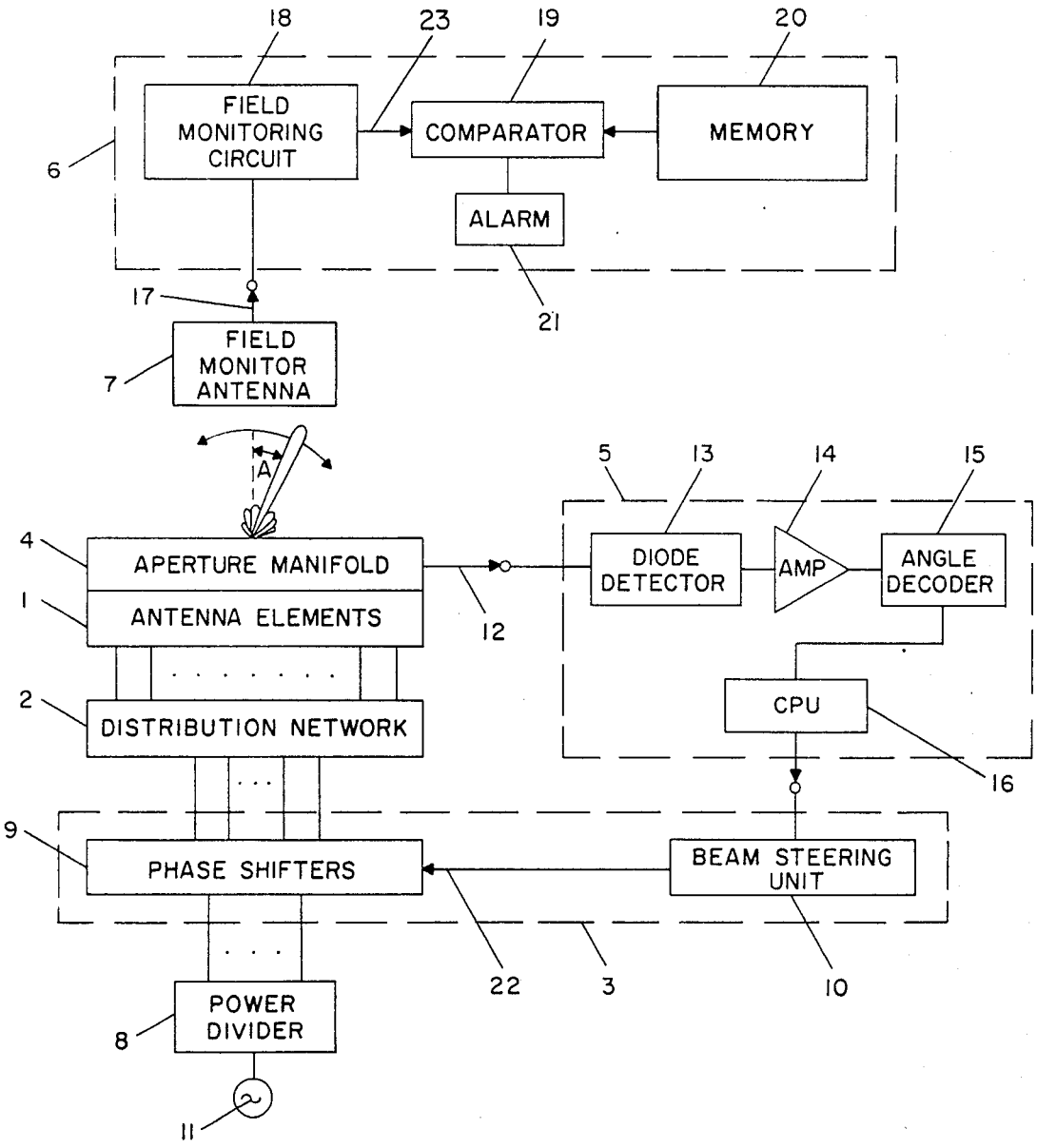
18
23
19
20
FIELD MONITORING CIRCUIT
COMPARATOR
MEMORY
6
ALARM
17
21
FIELD MONITOR ANTENNA
7
A
5
13
14
15
4
APERTURE MANIFOLD
DIODE DETECTOR
AMP
ANGLE DECODER
1
ANTENNA ELEMENTS
12
2
DISTRIBUTION NETWORK
CPU
16
9
PHASE SHIFTERS
BEAM STEERING UNIT
22
3
10
POWER DIVIDER
8
11

SCANNING ANTENNA WITH AUTOMATIC BEAM STABILIZATION

BACKGROUND OF THE INVENTION

1. Field of the Invention

The invention relates generally to scanning antennas and, in particular, to apparatus for automatically stabilizing the beam pointing accuracy of a scanning phased array antenna.

2. Description of the Prior Art

Scanning antennas, and, particularly, phased array antennas such as are found in microwave landing systems, have used slotted waveguides that monitor the aperture of the antenna. In phased arrays, biasing error is independent of the angle in space. In contrast, the angle error in beam port antennas is angle dependent. Typically, these waveguides are weakly coupled to the aperture and could be used to manually detect the array beam pointing bias error caused by RF phase perturbations in the antenna circuitry such as from temperature changes, temperature gradients and component degradation and replacements.

SUMMARY OF THE INVENTION

It is an object of this invention to provide a scanning antenna having automatic beam stabilization.

It is another object of this invention to provide apparatus for sensing and correcting through a feedback network the beam pointing angle of a scanning array antenna.

The invention is an antenna system for radiating wave energy signals in a selected region of space and in a desired radiation pattern. The invention comprises an aperture including an array of antenna elements and first means for coupling supplied wave energy signals to the antenna elements. Second means scans a beam radiated by the array resulting from the supplied wave energy signals. Third means measures a beam pointing angle of the radiated beam and provides an output representative of the beam pointing angle. A fourth means, associated with the second means, controls the scanning of the radiated beam in response to the output of the third means thereby automatically stabilizing the beam pointing angle of the radiated beam. The invention may further include means for providing an alarm in response to an output of a space-coupled monitor.

For a better understanding of the present invention, together with other and further objects, reference is made to the following description, taken in conjunction with the accompanying drawings, and its scope will be pointed out in the appended claims.

BRIEF DESCRIPTION OF THE DRAWING

The FIGURE is a block diagram illustrating an antenna system according to the invention.

DETAILED DESCRIPTION OF THE INVENTION

The invention is applicable to microwave landing systems which use wide scanning phased array antennas and limited scan phased array antenna systems having a sharp cut-off of the element pattern, such as are disclosed by Frazita et al. in U.S. Pat. No. 4,041,501, assigned to Hazeltine Corporation and incorporated herein by reference. Referring to the FIGURE, generally such antenna systems include one or more radiating elements forming an array 1 in which the elements are arranged along an array axis and are spaced from each other by a given distance. Each of the elements is coupled to a power divider 8 via a corresponding one of a plurality of phase shifters 9 connected to the elements by distribution network 2. Wave energy signals from signal generator 11 and power divider 8 are supplied to antenna elements 1 by phase shifters 9 such that a proper selection of the relative phase values for phase shifters 9 causes antenna elements 12 to radiate a desired (predetermined) radiation pattern into a selected angular region of space. Variation of the relative phase values of the phase shifters 9 is accomplished by beam steering unit 10 via control line 22 and causes the radiated antenna pattern to change direction with respect to angle A in space. Therefore, phase shifters 9 and beam steering unit 10 together form means 3 for scanning a beam radiated by the antenna elements of array 1 as a result of the supplied wave energy signals from generator 11 coupled to the elements of array 1 by power divider 8 and distribution network 2.

The properties of a scanning antenna and techniques for selecting design parameters such as aperture length, element spacing and the particular configuration of the distribution network 2 are well known in the prior art. A review of these parameters is completely described in U.S. Pat. No. 4,041,501, incorporated herein by reference.

In order to stabilize the beam pointing angle of the radiated beam, an aperture manifold 4 is associated with the antenna elements of array 1. The manifold 4 may be any means for forming a signal provided by output 12 which represents a beam pointing angle of the radiated beam. Preferably, manifold 4 is a highly stable waveguide or manifold of special design directly coupled to the array 1 and center-fed to avoid inherent frequency (phase) and temperature effects. Center feeding also eliminates first-order dependence on frequency and absolute temperature variations.

As used herein, manifold 4 refers to any type of device for sampling signals including a waveguide or a power combiner. A stable manifold is, by definition, one which is insensitive to frequency and temperature changes and is used in combination with a phased array in accordance with this invention to detect bias error at a specific angle. Manifold 4 is equivalent in function to a probe located in space at a specific angle with respect to the phased array. A manifold which may be used in accordance with the present invention may be a slotted waveguide configured to monitor radiated energy such that there is zero phase at all sample points of the manifold. This zero phase sampler at all points results in center feeding of the manifold 4.

The output 12 of manifold 4 is coupled to means 5, associated with means 3, for controlling the scanning of the radiated beam in response to the output 12 of monitor 4. Specifically, dedicated aperture manifold 4 may be a waveguide which is an integral part of the scanning beam antenna array 1. In microwave landing systems operating according to the format specified by the International Civil Aviation Organization (ICAO), manifold 4 develops a signal at output 12 representing the "TO-FRO" beam radiated by the aperture of array 1. The signal representing the "TO-FRO" beam is detected by diode detector 13 and amplified by amplifier 14. The detected, amplified signal is provided to an angle decoder 15, such as a dwell gate processor, where the signal representing the "TO-FRO" beam is decoded into a beam pointing angle and converted into digital data. The digital data is provided to CPU 16 for processing. CPU 16 includes stabilization software which determines the beam pointing direction of the array from the data and compares it to a predetermined value stored in memory. The difference between these compared values represents correction data which is applied to the beam steering unit 10. Unit 10 processes the correction data and uses it to adjust phase shifter commands 22 thereby removing or minimizing any beam pointing angle error which is detected.

Means 5 controls the scanning of the radiated beam in response to the output 12 of manifold 4. CPU 16 is programmed with the characteristics of the preamble and postamble of the scan. Diode detector 13, amplifier 14 and angle decoder 15 detect the preamble and postamble and provide this detected information to CPU 16 which analyzes the information and begins a clock running at the end of the preamble and stops the clock at the end of the postamble to measure the lapsed time. Between the preamble and the postamble, diode detector 13, amplifier 14 and angle decoder 15 continuously monitor the scan angle of the beam radiated by the antenna elements and being received by manifold 4. This continuous monitoring information is provided to CPU 16 and is discreetly sampled. The sampled information is processed by CPU 16 to determine the phase angle of the radiated beam. This phase angle is compared to the desired phase angle which is stored in the memory of CPU 16 and any differential between the compared angles is converted by CPU 16 into a control signal which is sent to beam steering unit 10. Upon receipt of the control signal, beam steering unit 10 adjusts the phase shifter commands 22 in response to this control signal. Preferably, the start/stop time of the scanning beam may be adjusted in response to the control signal thereby removing or minimizing any beam pointing error which is detected. In this alternative configuration, modification of the beam steering algorithm is avoided. This cycle is again repeated with each scan.

As a result, means 5 for controlling the scanning of the radiated beam in response to the output 12 of manifold 4 accomplishes automatic beam stabilization by circuitry which is independent of the antenna elements in the form of detector 13, amplifier 14, decoder 15, and CPU 16 which respond to the output 12 of an external aperture monitor illustrated as manifold 4. In the preferred embodiment, the control signal provided by CPU 16 is used by beam steering unit 10 to adjust the phase shifter commands 22 or the start/stop time of the scanning beam, in the case of a microwave landing system, so that the beam steering algorithm is not modified by the automatic beam stabilization of the invention.

Antenna elements 1 may be a slotted waveguide cavity which is center-fed to avoid frequency sensitivities within a 1.5% bandwidth. The length of the waveguide cavity is configured to create a standing wave wherein each wave has a constant phase. This may be accomplished by a resonant feed such as a line antenna feed (i.e., radiating antenna feed). Each half-wavelength of the standing wave is coupled to a radiating element (i.e., a slot in the case of a slotted waveguide cavity). The waveguide is then ridge-loaded to provide the proper impedance match. In the case of a slotted waveguide, the ridge-loading is a ridge located within the waveguide cavity. With such a waveguide configuration, absolute power radiated by the waveguide may change according to the radiated beam but relative power remains constant. For this reason, the stable manifold may be directly coupled to the waveguide for accurate monitoring of the biasing error.

The antenna system according to the invention may also be provided with separate and independent means 6, including field monitor antenna 7, for monitoring a beam pointing angle of the radiated beam and providing an output signal 17 representative thereof. Field monitor 7 may be a space-coupled monitor connected to field monitoring circuit 18 which converts output 17 into corresponding field signal 23 having a predetermined scale and magnitude. Circuit 18 provides output information to comparator 19 which also receives output information from memory 20. Memory 20 stores information relating to the acceptable beam pointing angle at any instant. Comparator 19 compares the output of field monitoring circuit 18 with information sampled from memory 20 and actuates an alarm 21 in the event that the comparison is beyond preset limits. Therefore, means 6 and monitor 7 can be used to independently detect failure of the manifold, the automatic stabilization circuitry or the array system.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

I claim:

1. In an antenna system for radiating wave energy signals into a selected region of space and in a desired radiation pattern comprising:

(a) an aperture comprising an array of antenna elements;

(b) first means for coupling supplied wave energy signals to the antenna elements; and (c) second means for scanning a beam radiated by the array in accordance with a predetermined pattern, said beam resulting from the supplied wave energy signals coupled to the antenna elements;

the improvement comprising:

a manifold directly coupled to said aperture and providing an output representative of the beaming pointing angle of a beam radiated by said aperture;

detecting means for detecting the output of the manifold;

decoding means associated with said detecting means for providing an output corresponding to the beam pointing angle represented by the detected output of the manifold; and controlling means for adjusting the start/stop time of the scanning of said beam whereby the predetermined pattern is not modified.

2. The antenna of claim 1 wherein said decoding means comprises a dwell gate processor.

* * * * *